US006089905A

United States Patent [19]

Shimmyo et al.

[11] Patent Number: 6,089,905

[45] Date of Patent: Jul. 18, 2000

[54] ELECTRICAL CONNECTOR CAPABLE OF AVOIDING INCOMPLETE CONNECTION OF A CONNECTION MEMBER

[75] Inventors: Minoru Shimmyo, Sagamihara; Tomoyuki Totani, Tachikawa; Akira Ohno, Oume; Yu Tatebe, Hachioji, all of Japan

[73] Assignee: Japan Aviation Electronics Industry, Limited, Tokyo, Japan

[21] Appl. No.: 09/304,373

[22] Filed: May 4, 1999

[30] Foreign Application Priority Data

May 8, 1998 [JP] Japan ..... 10-126284
Aug. 5, 1998 [JP] Japan ..... 10-221651

[51] Int. Cl.[7] ..... H01R 12/24

[52] U.S. Cl. ..... 439/495; 439/260

[58] Field of Search ..... 439/495, 260

[56] References Cited

FOREIGN PATENT DOCUMENTS 5-6759 1/1993 Japan .
6-77186 10/1994 Japan .

*Primary Examiner*—Lincoln Donovan
*Assistant Examiner*—Javaid Nasri
*Attorney, Agent, or Firm*—Laff, Whitesel & Saret, Ltd.; J. Warren Whitesel

[57] ABSTRACT

An electrical connector comprises an insulator (101) having an opening portion (102) for receiving a connection member (30) at a predetermined position over a plurality of contacts (103). A pressing member (105) is rotatably supported by the insulator (101). A locking arrangement (12, 128) is for locking the pressing member to the insulator only when the connection member (130) is properly positioned at the predetermined position. A detecting arrangement (**105*d*, 119) detects improper positioning of said connection member. The locking arrangement comprises a locking portion (125) formed on the insulator and an engaging projection (128) formed on the pressing member (105) to be engaged with the locking portion. The detecting arrangement (105*d*, 119) comprises a pair of locking arms (119) formed on the insulator and a detecting projection (105*d***) formed on the pressing member. When the connection member is partly inserted between the locking arms, the locking arms are pressed and deformed outwards to inhibit the rotation of the pressing member.

21 Claims, 17 Drawing Sheets

ELECTRICAL CONNECTOR CAPABLE OF AVOIDING INCOMPLETE CONNECTION OF A CONNECTION MEMBER

BACKGROUND OF THE INVENTION

This invention relates to an electrical connector for connecting a flat connection member such as a flexible flat cable (FFC) and a flexible printed circuit (FPC) to a connection object such as a printed circuit board (PCB).

A first conventional electrical connector of the type is disclosed in Japanese Unexamined Utility Model Publication (JP-U) No. 6-77186 (77186/1994). The first conventional electrical connector comprises an insulator housing having a base, a plurality of contacts fixed to the housing and having contact portions exposed above the base, and a pressing member rotatably supported to the housing. A connection member or FPC is at first disposed at a predetermined connecting position on the contact points of the plurality of contacts. Then, the pressing member is rotated to press the FPC against the contact points so that the FPC is connected to the contacts. The contacts are, for example, soldered to a PCB so that the FPC is connected to the PCB.

A second conventional electrical connector of the type is disclosed in Japanese Unexamined Utility Model Publication (JP-U) No. 5-6759 (6759/1993). The second conventional electrical connector comprises an insulator with a receptacle hole formed therein, a plurality of conductive contacts fitted in the receptacle hole, and a slider member. Each of the contacts has a holding portion held by the insulator at a rear side of the receptacle hole, a fixing portion extending from the holding portion towards a front side of the receptacle hole, and a contacting spring portion extending from the holding portion towards the front side of the receptacle hole in parallel to the fixing portion with a space kept therefrom. The contacting spring portion has a contact point formed at its one end to protrude towards the fixing portion.

The slider member has a slider base portion and a pressing portion extending from the slider base portion along the fixing portion to be removably inserted into the receptacle hole.

In the second conventional electrical connector, a connection member is inserted between the fixing portion and the contacting spring portion of each contact until the connection member reaches a predetermined connecting position over the contact points of the contacts. Then, the pressing portion of the slider member is placed on the connection member. Thereafter, the slider member is inserted into the receptacle hole and slides from the front side towards the rear side until the slider member reaches a predetermined slide position. At this time, the pressing portion presses the connection member against the contact points so that a plurality of conductive portions of the connection member are electrically connected to the contact points in press contact therewith.

However, the first conventional electrical connector is disadvantageous in the following respects. Specifically, in case where the connection member is not rightly disposed at the predetermined connecting position and the pressing member is rotated, connection between the connection member and the contact points becomes incomplete.

Even if the connection member is completely inserted to the predetermined connecting position, the connection member may be undesirably released from the insulator due to external force or vibration before the pressing member is rotated to the predetermined pressing position.

On the other hand, the second conventional electrical connector is disadvantageous in the following respects. Specifically, in case where the connection member is not completely inserted to the predetermined connecting position and the slider member slides to the predetermined slide position, connection between the connection member and the contact points becomes incomplete.

In addition, the contacting spring portion is continuously subjected to reactive force from the pressing portion of the slider member so that spring force of the contacting spring portion is gradually decreased. Thus, it is impossible to keep stable and reliable connection over a long period of time.

Even if the connection member is completely inserted to the predetermined connecting position, the connection member may be undesirably released from the insulator due to external force or vibration before the slider member slides to the predetermined slide position.

In both of the first and the second conventional electrical connectors, whether or not the connection member is completely inserted to the predetermined connecting position is confirmed through visual observation by an operator. Such confirmation is difficult and unreliable and often fails to detect incomplete insertion.

In the first conventional electrical connector, the connection member is held or clamped between the contact points of the contacts and the pressing member. In the second conventional electrical connector, the connection member is held or clamped between the contact points and the slider member. In either event, clamping force is weak and the connection member may easily be released from the insulator.

SUMMARY OF THE INVENTION

It is an object of this invention to provide an electrical connector capable of detecting incomplete connection of a connecting member.

It is another object of this invention to provide an electrical connector capable of avoiding a connection member from being easily released during a connecting operation.

It is still another object of this invention to provide an electrical connector capable of confirming proper positioning of a connection member by a click feeling.

It is yet another object of this invention to provide an electrical connector capable of increasing clamping force to keep stable connection after a connection member is completely connected.

It is a further object of this invention to provide an electrical connector capable of improving reliability of connection without being affected by variation in shape or deformation of an insulator.

According to this invention, there is provided an electrical connector comprising a single connector unit which includes an insulator (101) having an opening portion (102) for receiving a forward end portion of a flat connection member with a pair of protruding ends formed on both sides of the forward end portion, a plurality of conductive contacts (103) fitted in the opening portion to face to a plurality of conductive portions (135) formed on one surface of the forward end portion of the connection member, and a pressing member (105) rotatably supported on the insulator so that, after the forward end portion of the connection member is inserted into the opening portion in an inserting direction to reach a predetermined connecting position, the pressing member is rotated to a predetermined pressing position to press the forward end portion of the connection member against the contacts so that the conductive portions and the contacts are connected to each other, wherein the pressing member and the insulator are provided with locking means (125, 128) for locking the pressing member to the insulator after the pressing member is rotated to the predetermined pressing position only when the forward end portion of the connection member is properly located at the predetermined connecting position, and detecting means (105*d*, 119) for inhibiting, when the forward end portion of the connection member is not properly located at the predetermined connecting position, the rotation of the pressing member to detect that the forward end portion of the connection member is not properly located.

According to this invention, there is also provided an electrical connector comprising a plurality of the above-mentioned connector units arranged offset from one another in the inserting direction and stacked in a plurality of stages in a vertical direction.

According to this invention, the insulator (101) has a fitting portion (151) for fitting and connecting a mating connection element. The fitting portion has a plurality of connecting portions (153*b*) to be connected to a plurality of mating contacts of the mating connection element.

According to this invention, there is also provided an electrical connector comprising a pair of the above-mentioned connector units with their insulators (101) integrally connected to each other at the rear sides. The opening portion (102) and the pressing member (105) of one of the insulators are formed at positions symmetrical with those of the other insulator. The insulators are provided with the contacts symmetrically arranged. Each of the contacts of the one insulator and each corresponding one of the other insulator are coupled back to back at the holding portions through a coupling portion (103*y*) extending from the holding portions.

BRIEF DESCRIPTION OF THE DRAWING

FIG. 10 is a perspective view of the electrical connector in FIG. 4 when the connection member is inserted to a predetermined connecting position;

DESCRIPTION OF THE PREFERRED EMBODIMENTS

Figure 1:
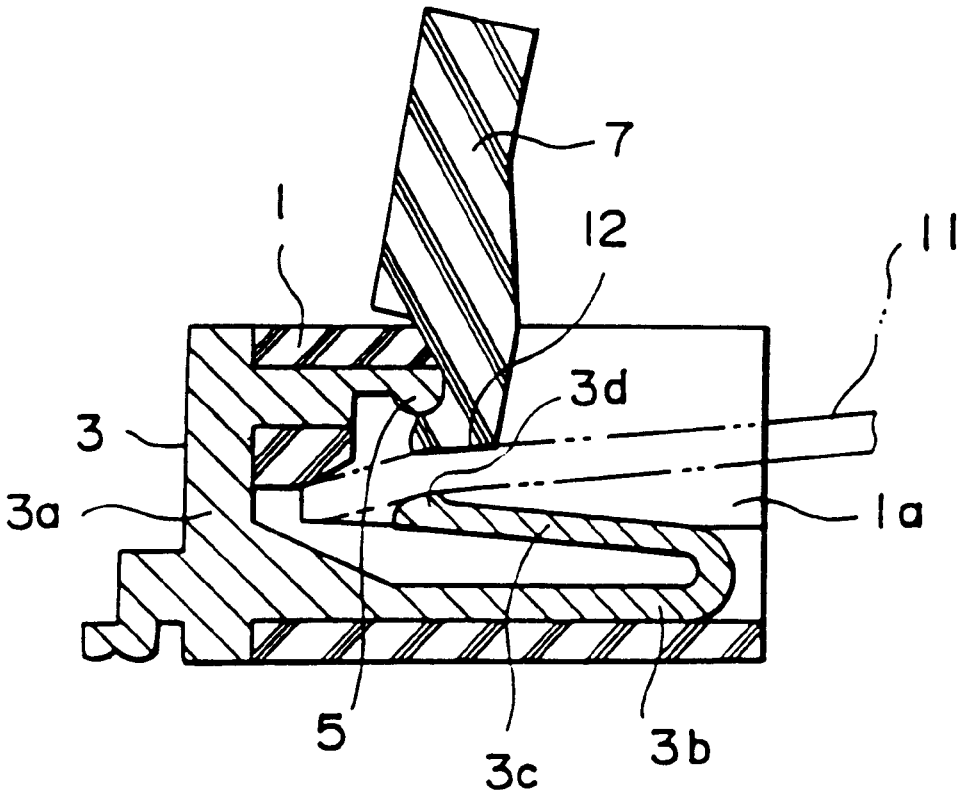
FIG. 1 PRIOR ART
FIG. 1 is a sectional view of a first conventional electrical connector with a connection member connected thereto.

For a better understanding of this invention, description will at first be made about conventional electrical connectors with reference to the drawing.

Referring to FIG. 1, a first conventional electrical connector comprises an insulator 1, a plurality of conductive contacts 3 (only one being illustrated in the figure) fitted to the insulator 1, and a pressing member 7 supported by the insulator 1.

The insulator 1 has a rotation support portion 5. The pressing member 7 is supported by the rotation support portion 5 to be rotatable between a predetermined pressing position closely adjacent to the contacts 3 and an open position apart from the predetermined pressing position. The pressing member 7 has a pressing protrusion 12 for pressing a connection member 11 against the contacts 3 when the pressing member 7 is rotated to the predetermined pressing position after the connection member 11 is located above the contacts 3 as will later be described.

Each of the contacts 3 has a holding portion 3*a* held by the insulator 1, a fixing portion 3*b* extending from the holding portion 3*b* towards an opening side of a receptacle hole la formed in the insulator 1, and a contacting spring portion 3*c* connected to the fixing portion 3*b* at the opening side of the receptacle hole la and extending in parallel to the fixing portion 3*b*. The contacting spring portion 3*c* has a contact point 3*d* formed at its one end to be connected to a conductive portion (not shown) of the connection member 11.

In the first conventional electrical connector mentioned above, the connection member 11 is at first inserted to a predetermined connecting position over the contact points 3*d* of the contacts 3. Then, the pressing member 7 is rotated from the open position to the predetermined pressing position to press the connection member 11 against the contact points 3*d* so that the connection member 11 is connected to the contact points 3*d*.

Figure 2:
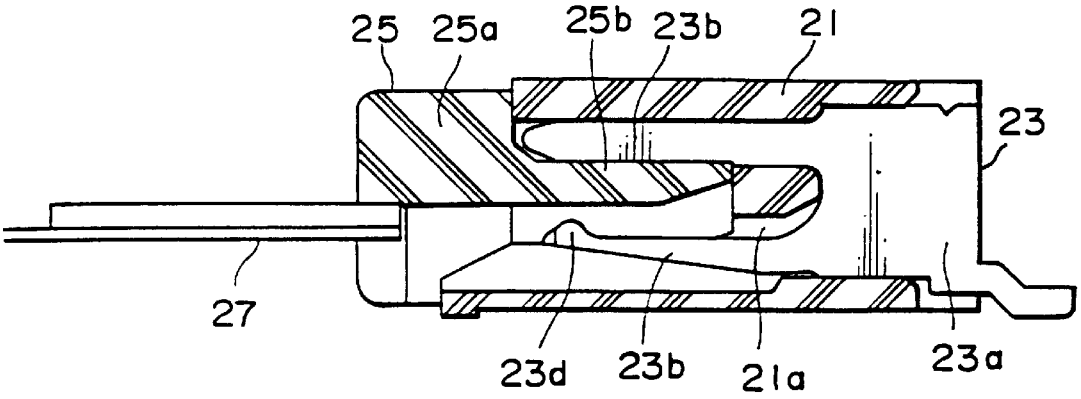
FIG. 2 PRIOR ART
FIG. 2 is a sectional view of a second conventional electrical connector with a connection member connected thereto.
Figure 3:
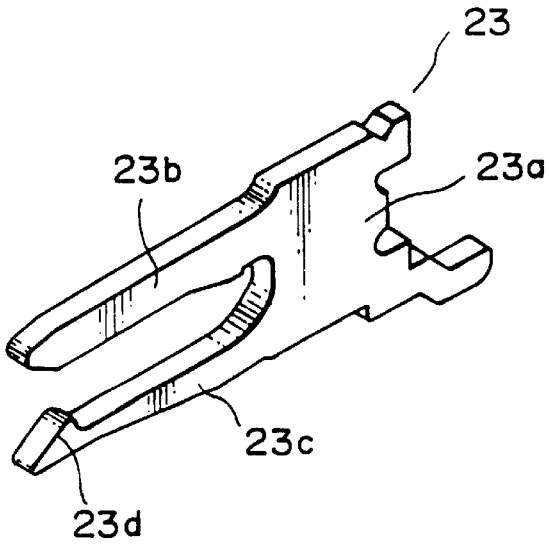
FIG. 3 PRIOR ART
FIG. 3 is a perspective view of a contact illustrated in FIG. 2.

Referring to FIGS. 2 and 3, a second conventional electrical connector comprises an insulator 21 with a receptacle hole 21*a* formed therein, a plurality of conductive contacts 23 (only one being illustrated in the figure) fitted in the receptacle hole 21*a*, and an insulating slider member 25 removably coupled to the insulator 21.

Each of the contacts 23 has a holding portion 23*a* held by the insulator 21 at a rear side of the receptacle hole 21*a*, a fixing portion 23*b* extending from the holding portion 23*a* towards a front side of the receptacle hole 21*a*, and a contacting spring portion 23*c* extending from the holding portion 23*a* towards the front side of the receptacle hole 21*a* generally in parallel to the fixing portion 23*b* with a space kept therefrom. The contacting spring portion 23*c* has a contact point 23*d* formed at its one end to protrude towards the fixing portion 23*b*.

The slider member 25 has a slider base portion 25*a* and a pressing portion 25*b* extending from the slider base portion 25*a* along the fixing portion 23*b* to be removably inserted into the receptacle hole 21*a*.

In the second conventional electrical connector mentioned above, a connection member 27 is inserted between the fixing portion 23*b* and the contacting spring portion 23*c* of each of the contacts 23 until the connection member 27 reaches a predetermined connecting position over the contact points 23*d* of the contacts 3. Then, the pressing portion 25*b* of the slider member 25 is placed on the connection member 27. Thereafter, the slider member 25 is inserted into the receptacle hole 21*a* and slides from the front side towards the rear side until the slider member reaches a predetermined slide position over the contact points 23*d*. At this time, the pressing portion 25*b* presses the connection member 27 against the contact points 23*d* so that a plurality of conductive portions of the connection member 27 are electrically connected to the contact points 23*d* in press contact therewith.

However, the first conventional electrical connector is disadvantageous in the following respects. Specifically, in case where the connection member 11 is not completely inserted to the predetermined connecting position and the pressing member 7 is rotated to the predetermined pressing position, connection between the connection member 11 and the contact points 13*d* becomes incomplete.

Even if the connection member 11 is completely inserted to the predetermined connecting position, the connection member 11 may be undesirably released from the insulator 1 due to external force or vibration before the pressing member 7 is rotated to the predetermined pressing position.

On the other hand, the second conventional electrical connector is disadvantageous in the following respects. Specifically, in case where the connection member 27 is not completely inserted to the predetermined connecting position and the slider member 25 slides to the predetermined slide position, connection between the connection member 27 and the contact points 23*d* becomes incomplete.

In addition, the contacting spring portion 23*c* is continuously subjected to reactive force from the pressing portion 25*b* of the slider member 25 so that spring force of the contacting spring portion 23*c* is gradually decreased. Thus, it is impossible to keep stable and reliable connection over a long period of time.

Even if the connection member 27 is completely inserted to the predetermined connecting position, the connection member 27 may be undesirably released from the insulator 21 due to external force or vibration before the slider member 25 slides to the predetermined slide position.

In each of the first and the second conventional electrical connectors, whether or not the connection member 11 or 27 is completely inserted to the predetermined connecting position is confirmed by visual observation. Such confirmation is difficult and unreliable and often fails to detect incomplete insertion.

In addition, the connection member 11 is held or clamped between the contact points 3*d* of the contacts 3 and the pressing member 7 in the first conventional electrical connector while the connection member 27 is held or clamped between the contact points 23*d* of the contacts 23 and the slider member 25 in the second conventional electrical connector. In either event, clamping force is weak and the connection member 11 or 27 may easily be released from the insulator 1 or 21.

Now, description will be made about several preferred embodiments of this invention with reference to the drawing.

Figure 4:
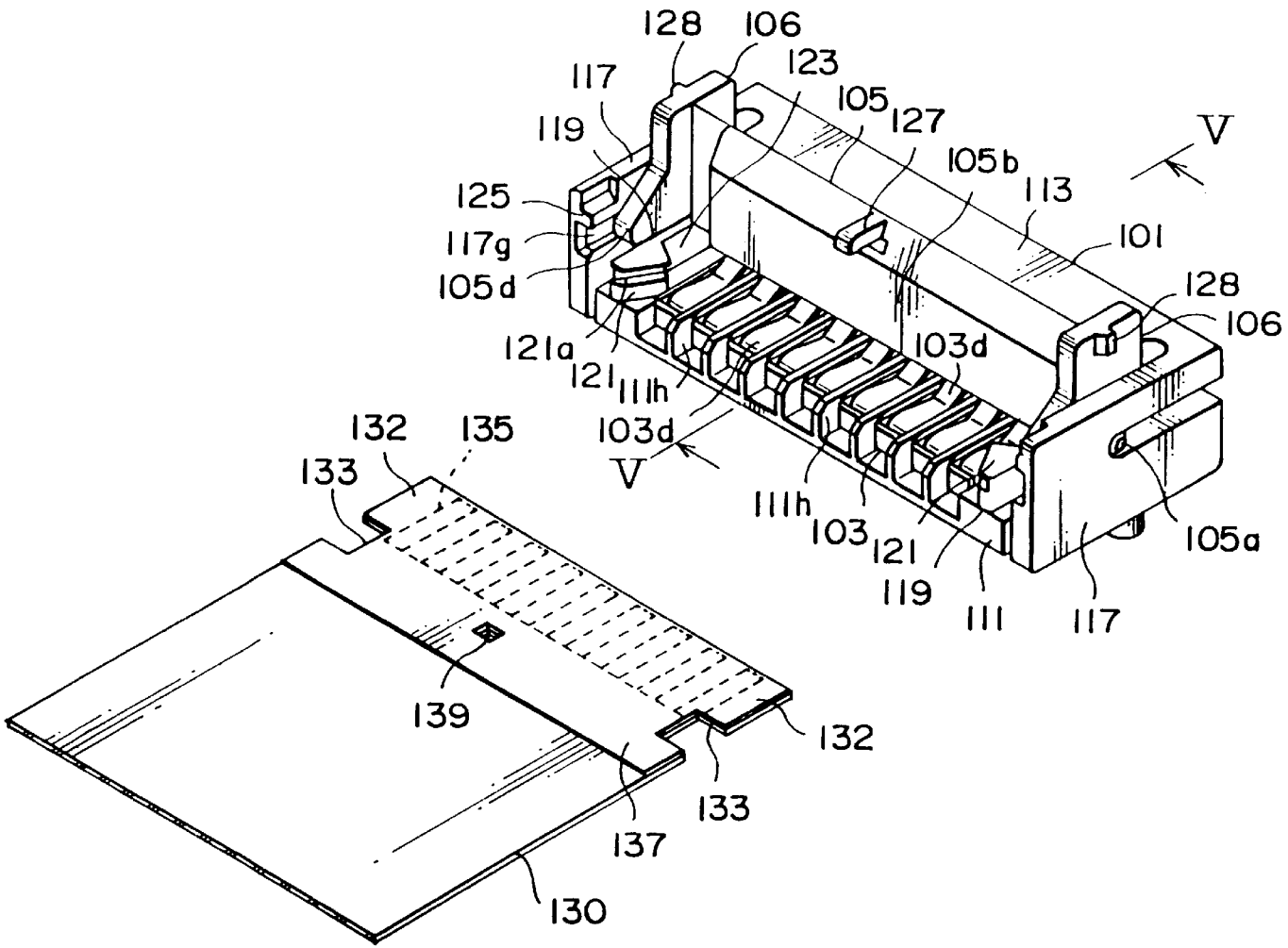
FIG. 4 is a perspective view of an electrical connector according to a first embodiment of this invention before a connection member is connected.
Figure 5:
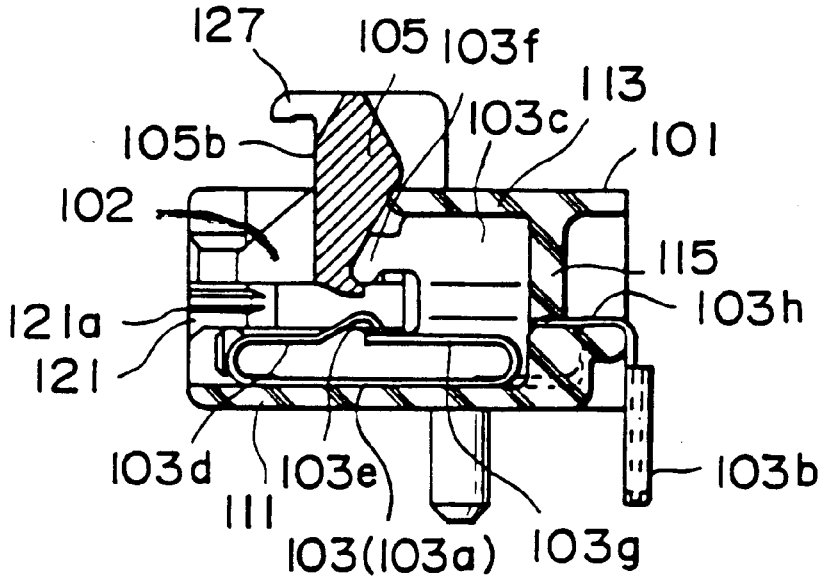
FIG. 5 is a sectional view taken along a line V—V in FIG. 4.

Referring to FIGS. 4 and 5, an electrical connector according to a first embodiment of this invention comprises an insulator 101 of a generally box-like shape, a plurality of conductive contacts 103 fitted in the insulator 101, and a pressing member 105 rotatably supported by the insulator 101.

When a connection member 130 is inserted into the insulator 101 in an inserting direction, the pressing member 105 serves to press the connection member 130 to connect the connection member 130 to the contacts 103. The connection member 130 has a pair of notches (locking portions) 133 formed in its forward end portion on both side edges in a widthwise direction perpendicular to the inserting direction. By presence of the notches 133, the forward end portion of the connection member 130 is provided with a pair of protruding edges 132 on both sides thereof. The connection member 130 has a plurality of conductive portions 135 formed on one surface of the forward end portion at a predetermined interval in the widthwise direction. Furthermore, an insulating backing plate 137 is attached to the other surface of the connection member 130 opposite to the one surface provided with the conductive portions 135.

The insulator 101 comprises a first plate portion 111 as a base, a second plate portion 113 located above the first plate portion 111 in parallel thereto, a rear plate portion 115 (FIG. 5) connecting rear ends of the first and the second plate portions 111 and 113 to each other, a pair of side plate portions 117 connecting side ends of the first and the second plate portions 111 and 113 to each other, and a pair of locking arms 119 each of which is connected to the rear plate portion 115 with a predetermined gap from an inner wall surface of each of the side plate portions 117.

The second plate portion 113 extends from the rear side towards the front side over a dimension shorter than that of the first plate portion 111. Each of the locking arms 119 extends from the rear side towards the front side in parallel to the inner wall surface of each of the side plate portions 117. The rear plate portion 115 is perpendicular to the first plate portion 111.

As described above, the second plate portion 113 has a shorter dimension as compared with the first plate portion 111. The insulator 101 has an opening portion 102 formed at the front side to receive the forward end portion of the connection member 130. In the first embodiment, the locking arms 119 are made of a material same as that of the insulator 101. The locking arms 119 are integral with the insulator 101.

Figure 6:
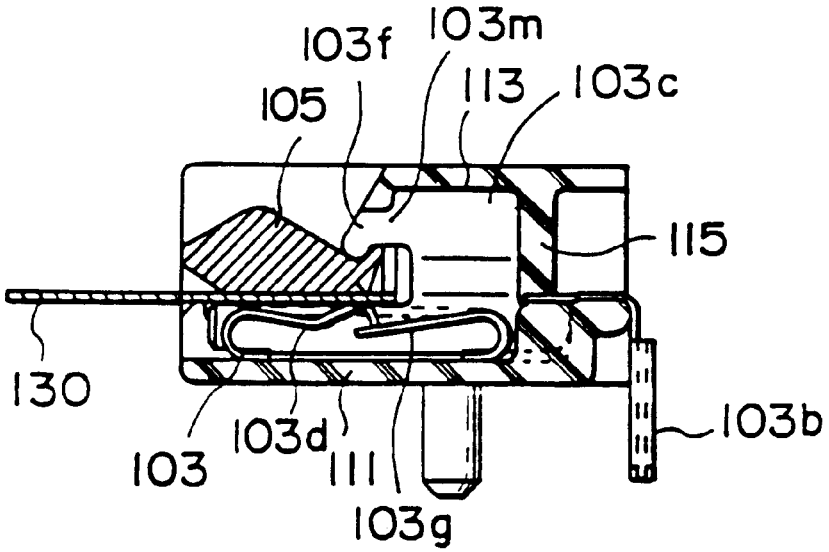
FIG. 6 is a sectional view similar to FIG. 5 when the connection member is completely connected.

Referring to FIG. 6, the pressing member 105 is rotatable from an open position illustrated in FIG. 5 to a predetermined pressing position illustrated in FIG. 6. The operation of the pressing member 105 will later be described in detail.

Figure 7:
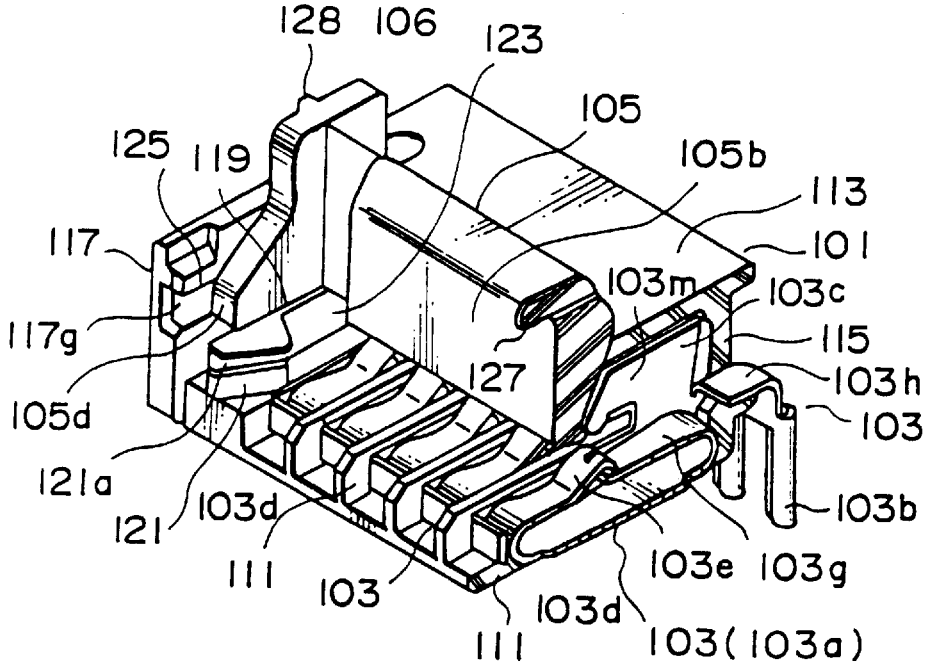
FIG. 7 is a partially-sectional perspective view for describing a contact illustrated in FIG. 4.
Figure 8:
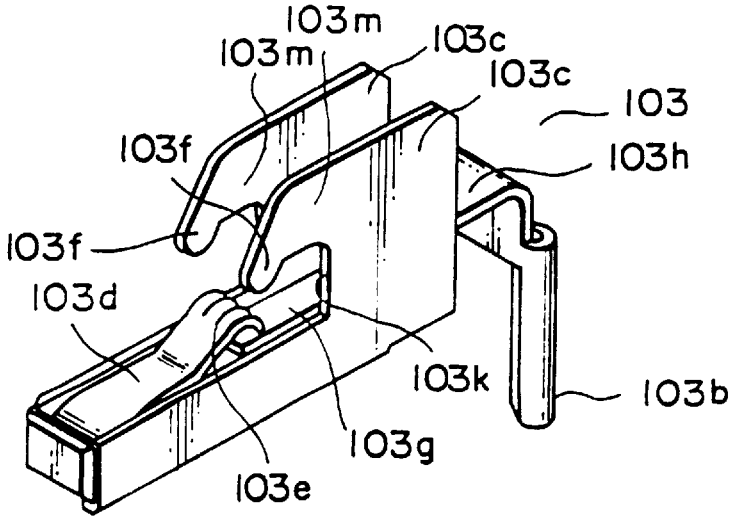
FIG. 8 is a perspective view of the contact illustrated in FIG. 4.

Referring to FIGS. 7 and 8 in addition to FIGS. 5 and 6, each of the contacts 103 has a contacting base 103*a* located on an inner surface of the first plate portion 111, a pair of holding portions 103*c* extending upward from both side edges of the contacting base 103*a*, a connecting portion 103*b* extending from the holding portions 103*c* to the outside of the insulator 101 and a contacting spring portion 103*d* connected to one longitudinal end of the contacting base 103*a* and extending therefrom towards the other longitudinal end.

The contacting spring portion 103*d* extends generally in parallel to the contacting base 103*a*. The contacting spring portion 103*d* has a contact point 103*e* formed at its extending end to be brought into contact with each of the conductive portions 135 of the connection member 130. The contact point 103*e* of the contacting spring portion 103*d* is formed by arcuately bending the extending end portion of the contacting spring portion 103*d* so as to be connected to the conductive portion 135 of the connection member 130.

The contacts 103 are arranged in one-to-one correspondence in a plurality of compartments defined by a plurality of vertical partition walls 111*h* formed on the inner surface of the first plate portion 111. The contact points 103*e* protrude upward to a level higher than upper ends of the partition walls 111*h*. The contacting spring portions 103*d* are arranged in the opening portion 102 of the insulator 101. Each of the holding portions 103*c* has a support arm portion 103*m*.

The contacting base 103*a* has an auxiliary spring portion 103*g* extending from the other longitudinal end towards the one longitudinal end in parallel to the contacting base 103*a*. The auxiliary spring portion 103*g* has an extending end located beneath the contact point 103*e*.

The support arm portion 103*m* has a generally semicircular arm pivot 103*f* formed at its free end to protrude towards the contacting spring portion 103*d*. The arm pivot 103*f* serves as an axis of rotation of the pressing member 105 in a range of a predetermined arc. The arm pivot 103*f* has a generally semicircular shape so as to allow the rotation of the pressing member 105. The arm pivot 103*f* receives reactive force from the contacting spring portion 103*d*.

The holding portion 103*c* is provided with a supporting notch 103*k* formed below the support arm 103*m* to receive the forward end portion of the connection member 130. A combination of the contacting base 103*a*, the contacting spring portion 103*d*, and the auxiliary spring portion 103*g* is generally flat and almost annular as seen from a lateral side.

The contacting base 103*a* and the connecting portion 103*b* are connected to each other through a coupling portion 103*h*. The connecting portion 103*b* is inserted into a through hole formed in a printed circuit board (not shown) and is soldered thereto.

The pressing member 105 is located between the side plate portions 117. The pressing member 105 has a pair of shaft portions 105*a* (FIG. 4) formed on outer surfaces of a pair of pressing plates 106, respectively. The shaft portions 105*a* are rotatably supported by the side plate portions 117 so that the pressing member 105 is rotated from the open position to the predetermined pressing position to open and close the opening portion 102 above the contacting spring portions 103*d*. Each of the pressing plates 106 has a detecting projection 105*d* which enters into a gap between the inner surface of the side wall portion 117 and the locking arm 119 when the pressing member 105 is rotated to the predetermined pressing position over the contacting spring portions 103*d*.

The pressing member 105 has a flat pressing surface 105*b* for bringing the conductive portions 135 into contact with the contact points 103*e* when the pressing member 105 is rotated to the predetermined pressing position as illustrated in FIG. 6. The pressing surface 105*b* of the pressing member 105 presses the conductive portions 135 of the connection member 130 located on the contacting spring portions 103*d* to provide tight contact therebetween.

When the pressing member 105 is rotated to the predetermined pressing position, the side plate portions 117 and the pressing plates 106 are engaged with each other to form a locking arrangement for preventing deformation of the locking arms 119 when the pressing member 105 is rotated to close the opening portion 102 above the contacting spring portions 103*d*.

The locking arms 119 and the detecting projection 105*d* of the pressing member 105 form a detecting arrangement for detecting whether or not the conductive portions 135 of the connection member 130 are properly positioned on the contacting points 103*e*.

The locking arrangement comprises a pair of locking portions 125 formed on the inner surfaces of the side plate portions 117, respectively, and a pair of engaging projections 128 formed on the outer surfaces of the pressing plates 106. The engaging projections 128 are engaged with the locking portions 125 when the pressing member 105 is rotated to the predetermined pressing position to completely close the opening portion 102 above the contacting spring portions 103*d*.

Each of the locking arms 119 has an arm projection 121 formed on its one end at the front side and an arm spring portion 123 extending from the arm projection 121 towards the rear side. The arm projection 121 serves to guide the connection member 130 to the predetermined connecting position over the contacting spring portions 103*d*. When the connection member 130 is inserted between the locking arms 119, the arm spring portions 123 are pressed by the both side edges of the connection member 130 to be widened and deformed. Thus, the distance between the locking arms 119 is designed to be smaller than the width of the forward end portion of the connection member 130, i.e., the distance between the side edges.

Each of the arm projections 121 has a guide groove 121*a* to guide each of the side edges of the forward end portion of the connection member 130. The guide groove 121*a* has a tapered shape narrowing from the front side towards the rear side.

Turning back to FIG. 4, the connection member 130 has a hook receiving hole 139 formed at its forward end portion. On the other hand, the pressing member 105 has a hook portion 127 formed at its center to be engaged with the hook receiving hole 139 when the pressing member 105 is rotated to the predetermined pressing position to close the opening portion 102 over the contacting spring portions 103*d*. The hooking portion 127 is formed in the vicinity of the pressing surface 105*b* to protrude above the pressing surface 105*b*.

The arm pivot 103*f* formed adjacent to the holding portion 103*c* of the contact 103 is brought into contact with an upper surface of the one end of the pressing member 105 to hold the pressing member 105 rotated to the predetermined pressing position.

Referring to FIGS. 9 through 14 in addition, an operation of connecting the connection member 130 to the electrical connector will be described.

Figure 9:
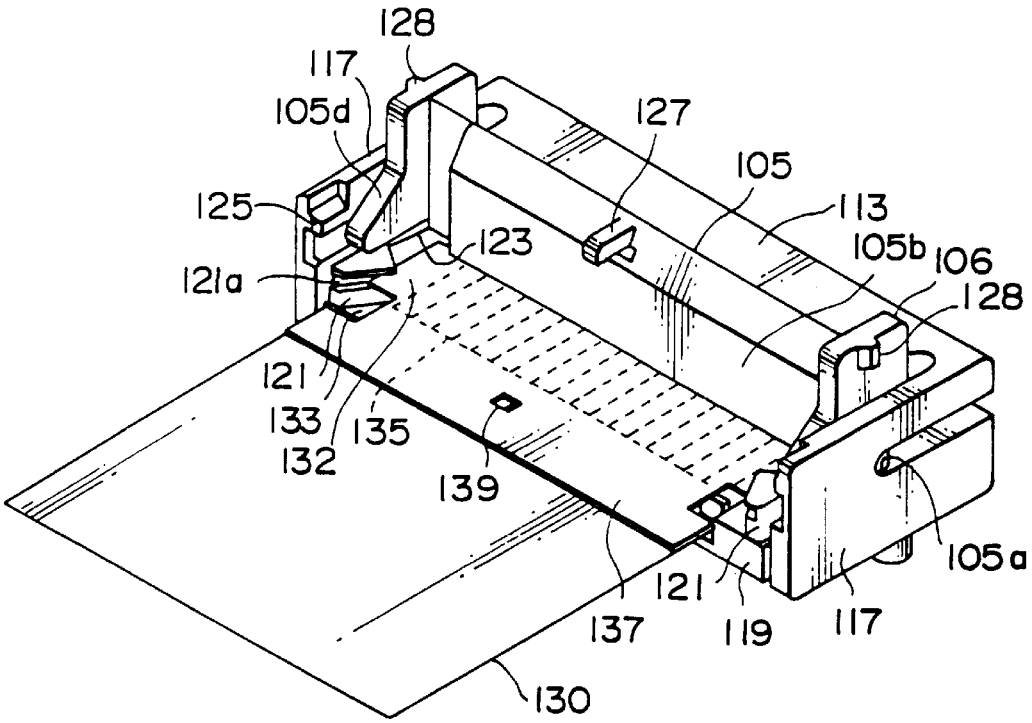
FIG. 9 is a perspective view of the electrical connector in FIG. 4 when the connection member is partly inserted.

At first referring to FIG. 9, the both side edges of the forward end portion of the connection member 130 are inserted into the guide grooves 121*a* of the arm projections 121. At this time, the arm spring portions 123 are deformed by the both side edges of the forward end portion of the connection member 130 to displace the arm projections 121 towards the inner surfaces of the side plate portions 117. In this state, a gap between the inner surface of the side plate portion 117 and the arm projection 121 becomes small to inhibit the detecting projection 105*d* of the pressing member 105 from entering into the gap between the inner surface of the side plate portion 117 and the arm projection 121. Thus, the pressing member 105 is inhibited from being rotated.

Thus, the detecting arrangement comprising the locking arms 119 and the detecting projections 105*d* prevents the pressing member 105 from being undesirably rotated when the connection member 130 is not completely inserted. In other words, the detecting arrangement comprising the locking arms 119 and the detecting projections 105*d* detects incomplete connection of the connection member 130.

Figure 10:
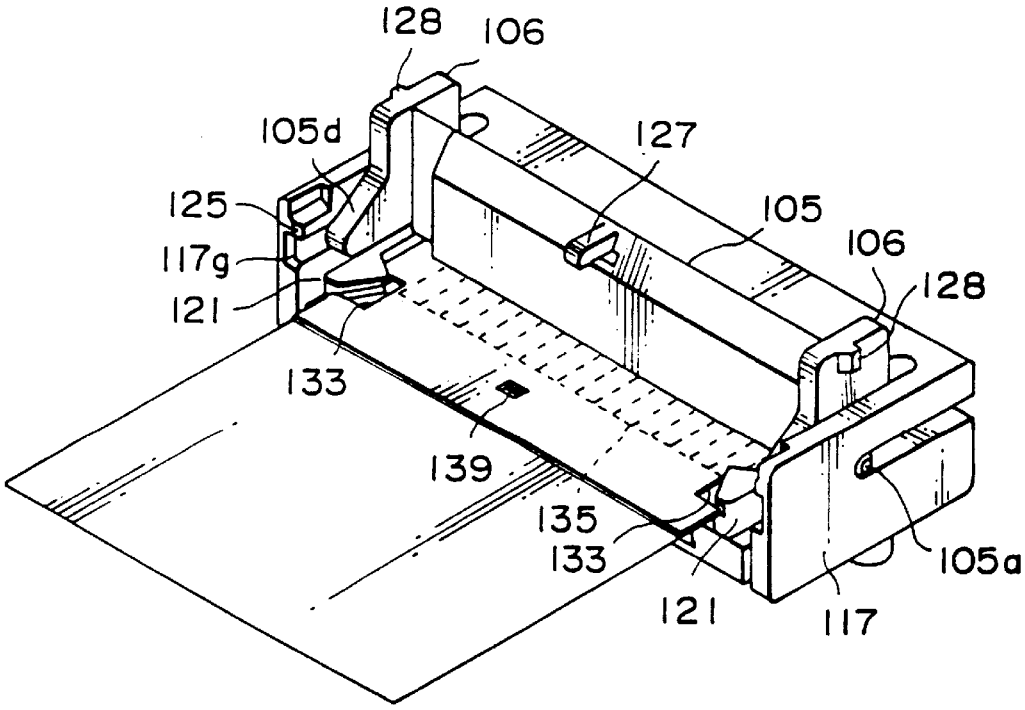
FIG. 10 is a perspective view of the electrical

When the connection member 130 is further inserted rearward, the arm projections 121 enter into the notches 133 of the connection member 130 as illustrated in FIG. 10. At this time, the connection member 130 is completely inserted to the predetermined connecting position in the insulator 101. Then, each of the arm spring portions 123 is returned from a deformed position into an initial position. Therefore, during the connecting operation, a click feeling is obtained when the arm spring portion 123 returns from the deformed position into the initial position. The connection member 130 is inhibited from being released because the notches 133 are engaged with the arm projections 121. Thus, the connection member 130 is locked in a provisional locking condition.

Figure 11:
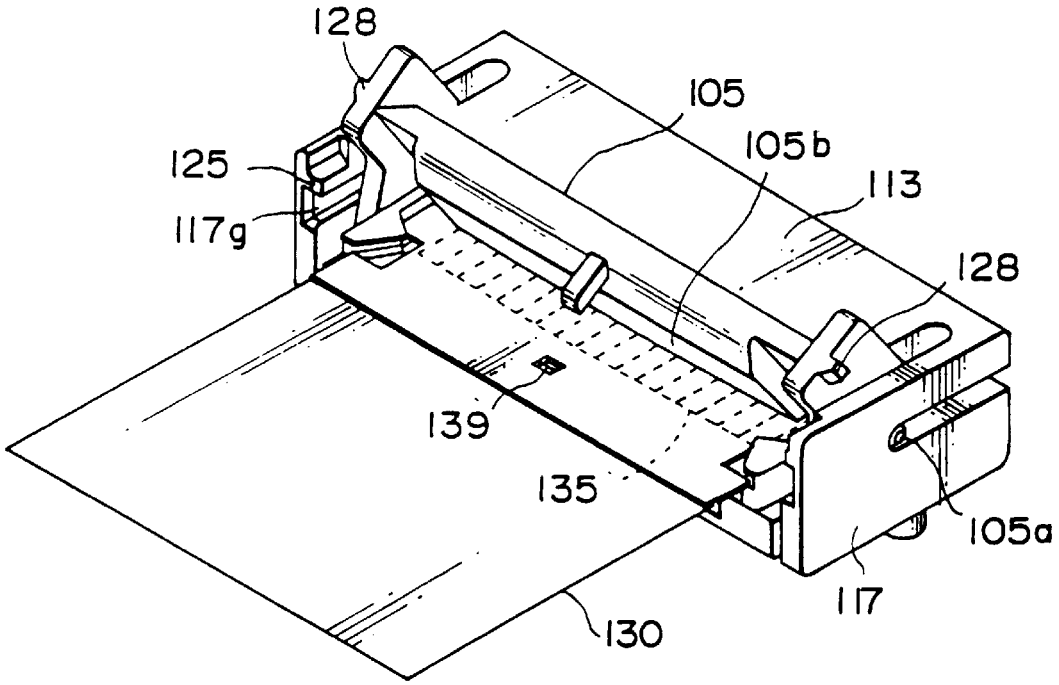
FIG. 11 is a perspective view of the electrical connector in FIG. 4 when a pressing member is in the middle of rotation.
Figure 12:
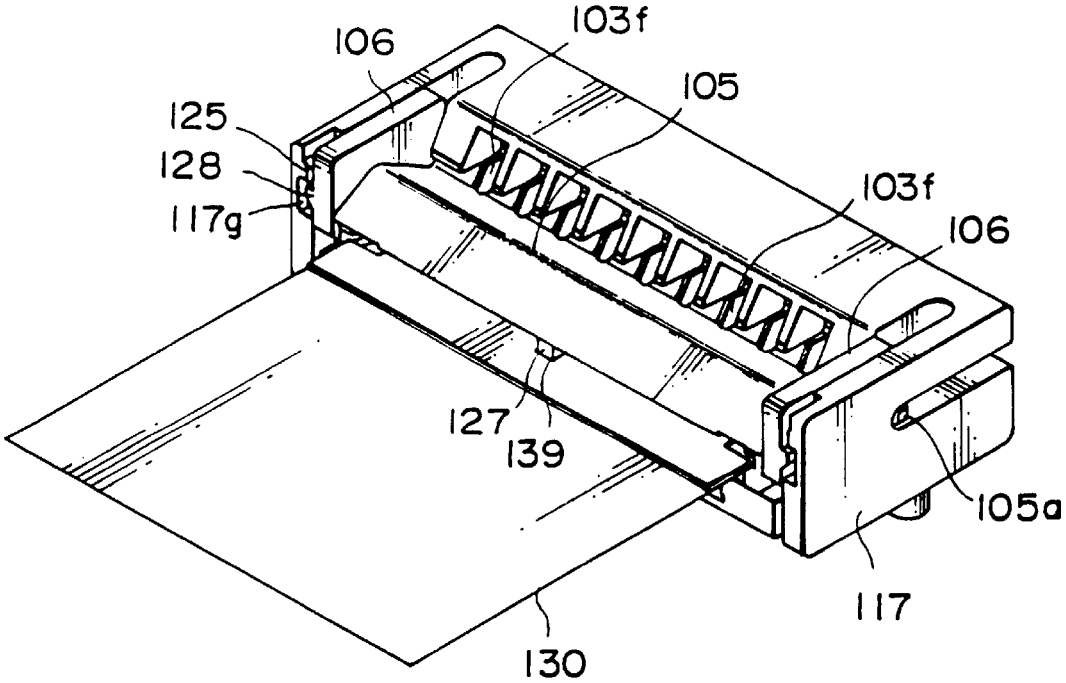
FIG. 12 is a perspective view of the electrical connector in FIG. 4 when the pressing member is rotated to a predetermined pressing position.

Thereafter, when the pressing member 105 is rotated, the detecting projections 105*d* enter into the gaps between the inner wall surfaces of the side plate portions 117 and the arm projections 121, respectively, as illustrated in FIGS. 11 and 12. At this time, the engaging projections 128 formed on the side surfaces of the pressing plates 106 pass across the locking portions 125 to be fitted into grooves 117*g* formed on the inner surfaces of the side plate portions 117. Now, the engaging projections 128 are engaged with the locking portions 125 to inhibit the rotation of the pressing member 105 towards the open position.

Figure 13:
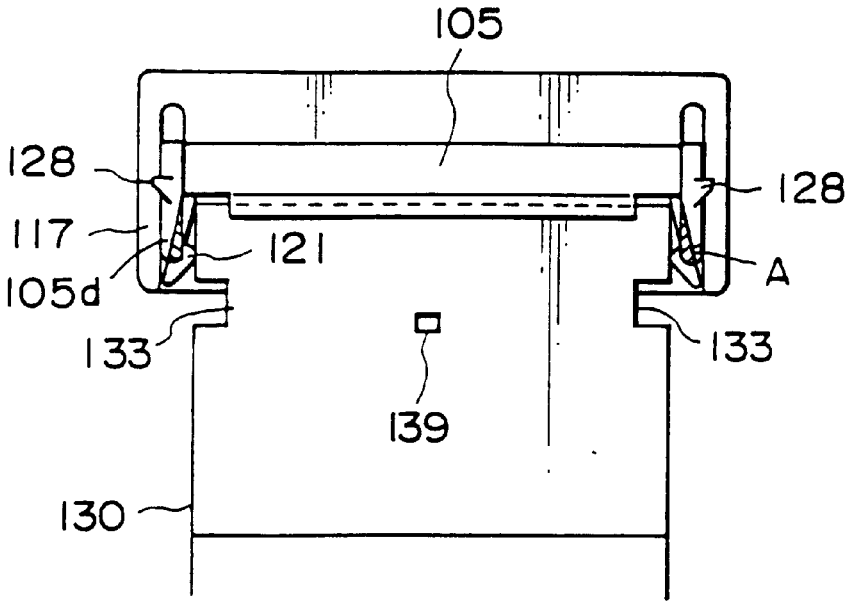
FIG. 13 is a plan view of the electrical connector in FIG. 9.

Referring to FIG. 13 corresponding to FIG. 9, the connection member 130 is partly inserted between the locking arms 119. As seen from FIG. 13, the detecting projections 105*d* are interfered by the arm projections 121 in hatched portions depicted by A. Thus, incomplete connection is detected by the detecting projections 105*d*.

Figure 14:
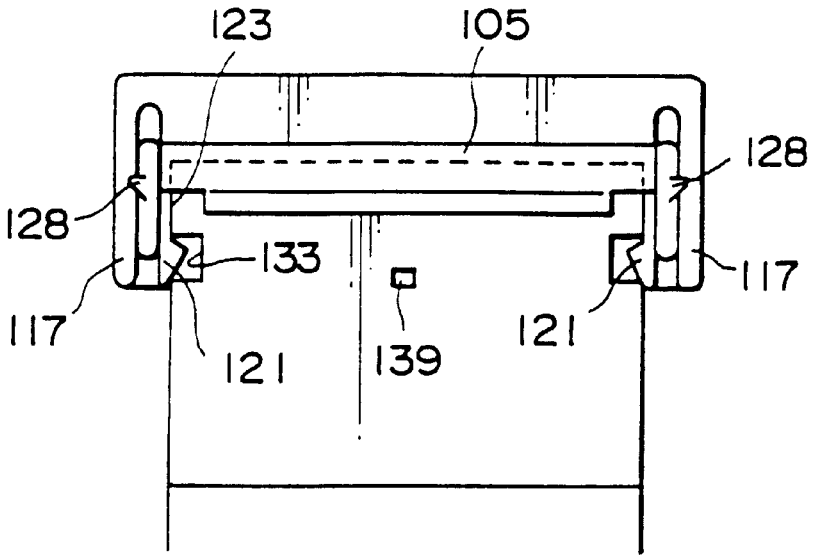
FIG. 14 is a plan view of the electrical connector in FIG. 10.

Referring to FIG. 14 corresponding to FIG. 10, the connection member 130 is completely inserted. In this state, the arm projections 121 are displaced outwards and no longer interfere the detecting projections 105.

Turning back to FIG. 10, when the detecting projections 105*d* enter into the gaps between the side plate portions 117 and the arm projections 121, the hook portion 126 of the pressing member 5 is inserted into and engaged with the hook receiving hole 139 of the connection member 130. The engagement between the hook receiving hole 139 and the hook portion 126 inhibits the connection member 130 from being undesirably released from the insulator 101. In order to remove the connection member 130 from the insulator 101, the above-mentioned operation is carried out in a reverse order.

The forward end portion of the connection member 130 is inserted into the supporting notches 103*k* of the contacts 103. When the forward end of the connection member 130 reaches the bottoms of the supporting notches 103*k*, the connection member 130 is completely inserted to the predetermined connecting position. In this event, the conductive portions 135 are brought into contact with the contact points 103*e*. Thereafter, when the pressing member 105 is rotated around the arm pivot 103*f* as illustrated in FIG. 6, the pressing surface 105*b* presses the connection member 130 against the contacting spring portions 103*d* to deform the contacting spring portions 103*d*. The forward end of the connection member 130 and the one end of the pressing member 105 are received in the supporting notches 103*k*. Thus, the forward end portion of the connection member 130 is fixedly clamped by the arm pivots 103*f* and the contacting spring portions 103*d* under spring force and reactive force, respectively.

Since each of the contacting spring portions 103*d* is located between the holding portions 103*c*, the connection member 130 is stably clamped by the holding portions 103*c* and the contact point 103*e*. The contact 103 of the above-mentioned shape provides stable connection irrespective of the shape of the insulator 101 supporting the contacts 103.

Figure 15:
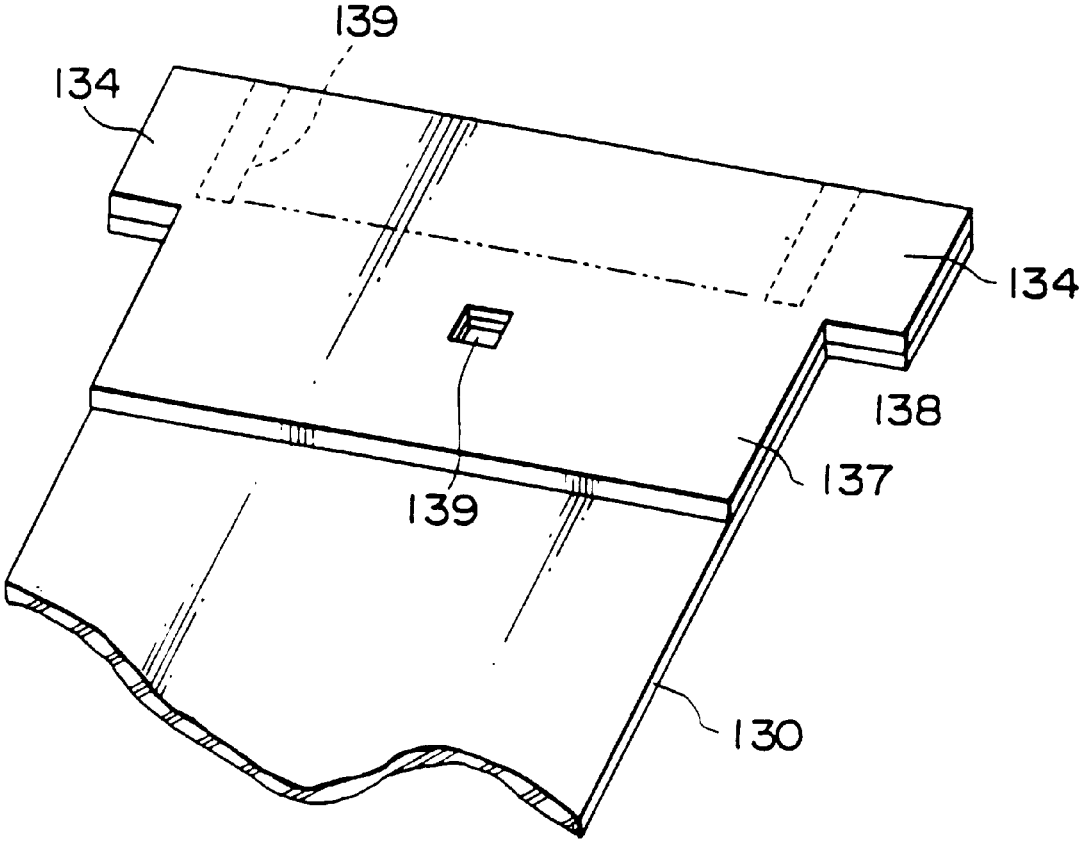
FIG. 15 is a perspective view of a modification of the connection member illustrated in FIG. 4.

Referring to FIG. 15, the connection member 130 is modified in shape. Specifically, the connection member 130 does not have the notches 133 in the foregoing description. As seen from the figure, the connection member 130 simply has a pair of protruding edges 134 formed at its forward end portion to protrude in the widthwise direction. By the presence of the protruding edges 134, the connection member 130 is provided with a pair of step portions (engaging portions) 138. The step portions 138 have a function equivalent to that of the notches 133.

In the electrical connector according to the first embodiment of this invention, a single connector unit is formed by the insulator 101, the contacts 103, and the pressing member 105 with the locking and the detecting arrangements.

Figure 16:
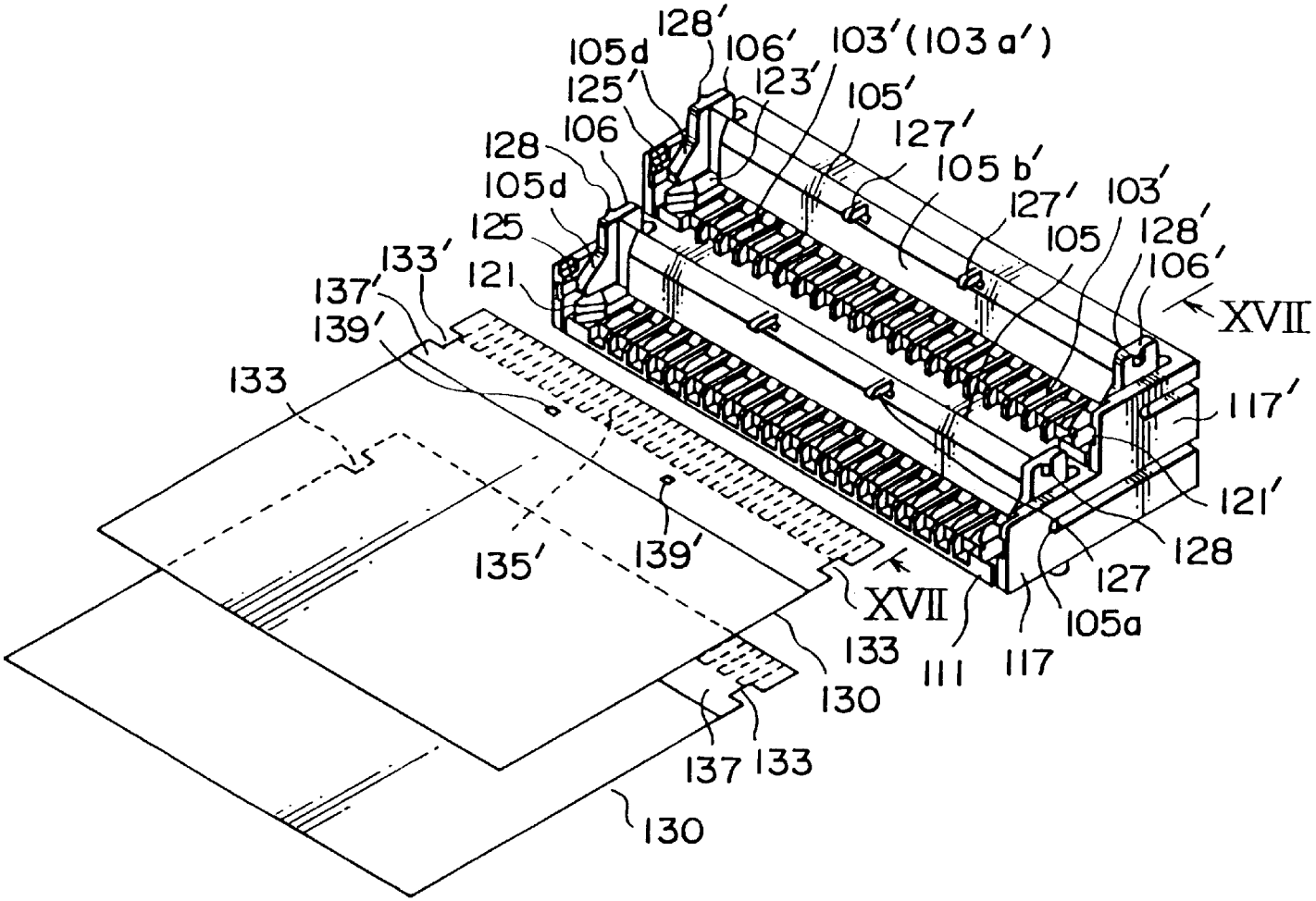
FIG. 16 is a perspective view of an electrical connector according to a second embodiment of this invention before two connection members are connected.
Figure 17:
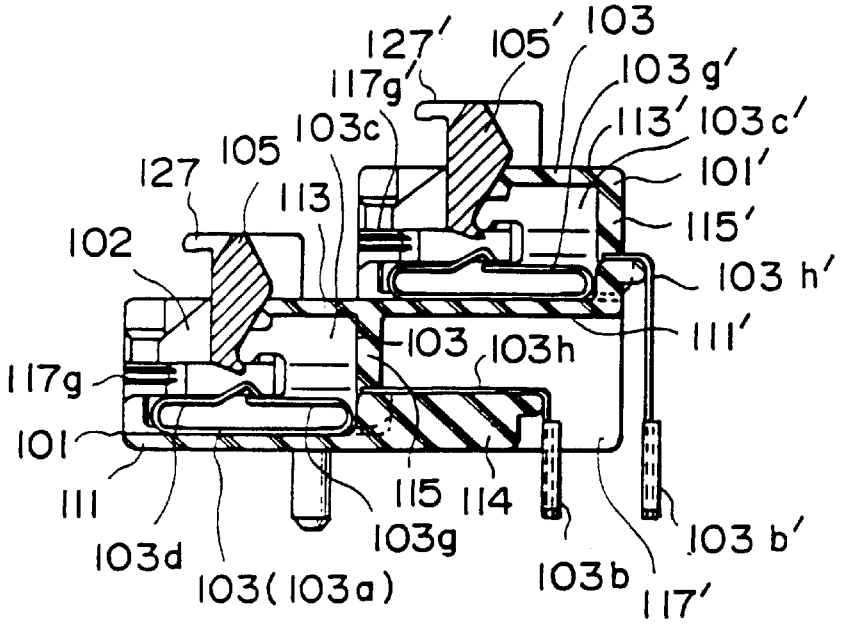
FIG. 17 is a sectional view taken along a line XVII—XVII in FIG. 16.
Figure 18:
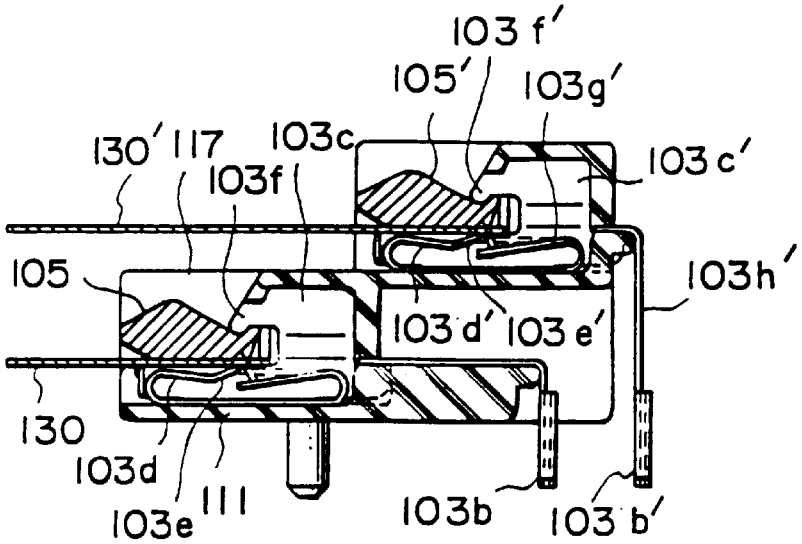
FIG. 18 is a sectional view similar to FIG. 17 when the connection members are connected.

Referring to FIGS. 16 through 18, an electrical connector according to a second embodiment of this invention comprises a plurality of (two in the illustrated example) connector units mentioned above.

As illustrated in FIGS. 16 through 18, the electrical connector comprises an additional insulator 101', a plurality of additional contacts 103', and an additional pressing member 105' in addition to the insulator 101, the contacts 103, and the pressing member 105 described in conjunction with the first embodiment.

The insulator 101 is integrally coupled with the additional insulator 101' (FIG. 17) comprising a first additional plate portion 111', a second additional plate portion 113', and an additional rear plate portion 115'. Specifically, the first plate portion 111 of the insulator 101 integrally connected with a base plate portion 114 extending rearward. The base plate portion 114 is greater in thickness than the first plate portion 111. The second plate portion 113 of the insulator 101 is integrally connected with the first additional plate portion 111' extending rearward. Above the first additional plate portion 111', the second additional plate portion 113' similar to the second plate portion 113 of the insulator 101 extends in parallel to the first additional plate portion 111'. The first and the second additional plate portions 111' and 113' are connected by the additional rear plate portion 115' similar to the rear plate portion 115.

On the first additional plate portion 111', the additional contacts 103' similar to the contacts 103 and the additional pressing member 105' similar to the pressing member 105 are arranged in the manner similar to the first embodiment.

Thus, in the electrical connector of the second embodiment, a pair of the connector units each of which is described in conjunction with the first embodiment are arranged offset in the inserting direction and stacked in two stages in the vertical direction.

In the lower connector unit, the connection member 130 is inserted into the insulator 101 and the pressing member 105 is rotated. In the upper connector unit, an additional connection member 130' is inserted into the additional insulator 101' and the additional pressing member 105' is rotated. The connection member 130 and the additional connection member 130' are pressed by the pressing member 105 and the additional pressing member 105' to be connected to the contacts 103 and the additional contacts 103', respectively.

In the second embodiment, the pressing member 105 and the additional pressing member 105' are provided with two hook portions 127 and two additional hook portions 127', respectively. On the other hand, the connection member 130 and the additional connection member 130' are provided with two hook receiving holes 139 and the additional hook receiving holes 139', respectively. The hook receiving holes 139 and the additional hook receiving holes 139' are engaged with the two hook portions 127 and the two additional hook portions 127' in one-to-one correspondence.

The contacts 103 and the additional contacts 103' of the second embodiment are slightly different in shape from the contacts 103 in the first embodiment. Specifically, the coupling portion 103*h* of each of the contacts 3 extends along the base plate portion 114 in the second embodiment. Similarly, an additional coupling portion 103*h'* of each of the additional contacts 103' is longer than the coupling portion 103*h* in the first embodiment.

Other structures of the additional insulator 101', the additional contacts 103', and the additional pressing members 105' are similar to those of the insulator 101, the contacts 103, and the pressing member 105 of the first embodiment. Similar parts are designated by like reference numerals and will not be described any longer.

Referring to FIGS. 19 through 25, an electrical connector according to a third embodiment of this invention is adapted to removably connect the connection member 130 and a mating connector. For this purpose, the electrical connector is different in structure from the first embodiment in that a fitting portion for fitting the mating connector is provided.

In the following, description will mainly be directed to the fitting portion and the mating connector. The remaining structure for connection of the connection member 130 is similar to the first embodiment. The similar parts are designated by like reference numerals and will not be described any longer.

Figure 19:
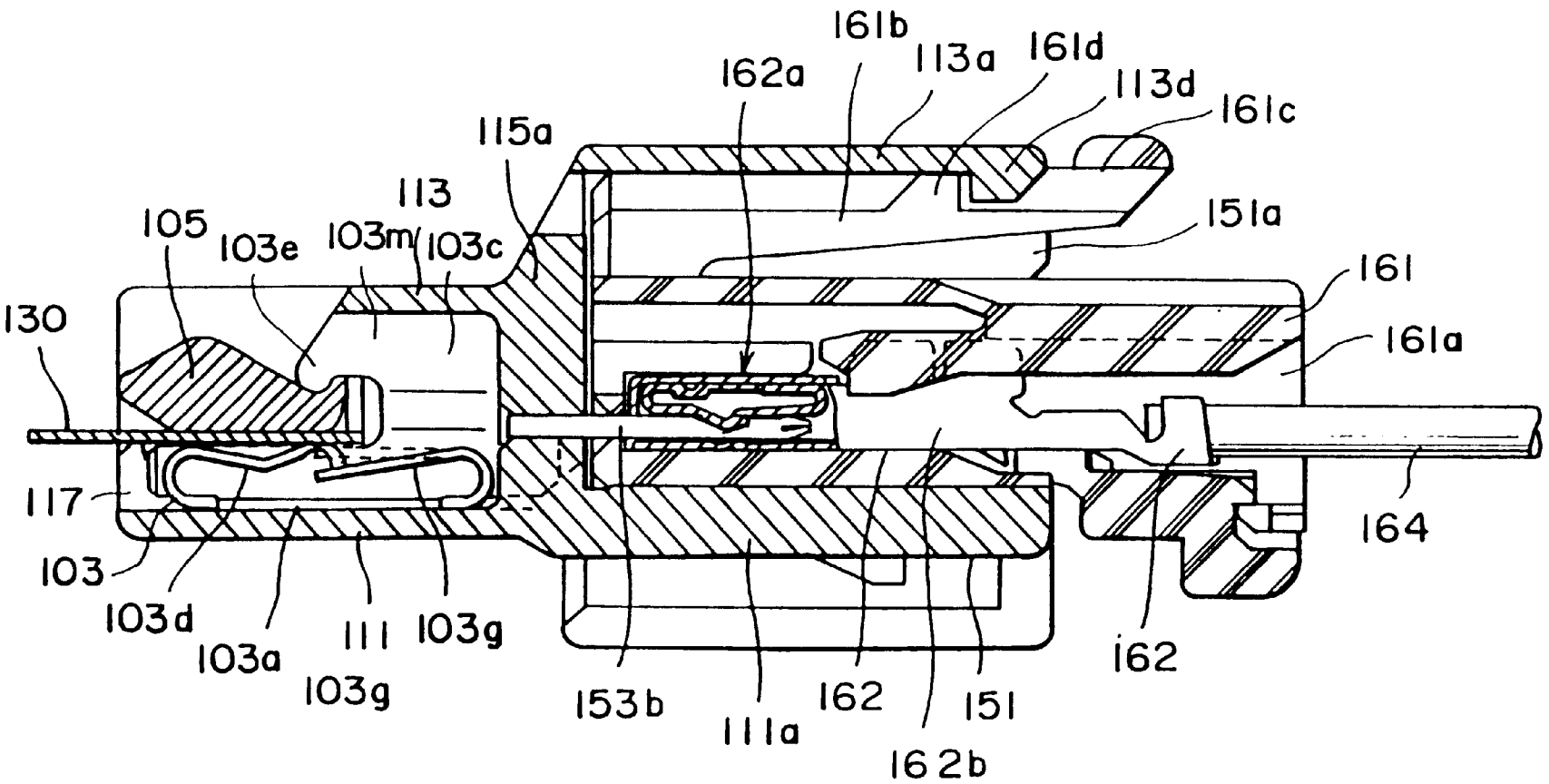
FIG. 19 is a sectional view of an electrical connector according to a third embodiment of this invention with a mating connector connected thereto.
Figure 20:
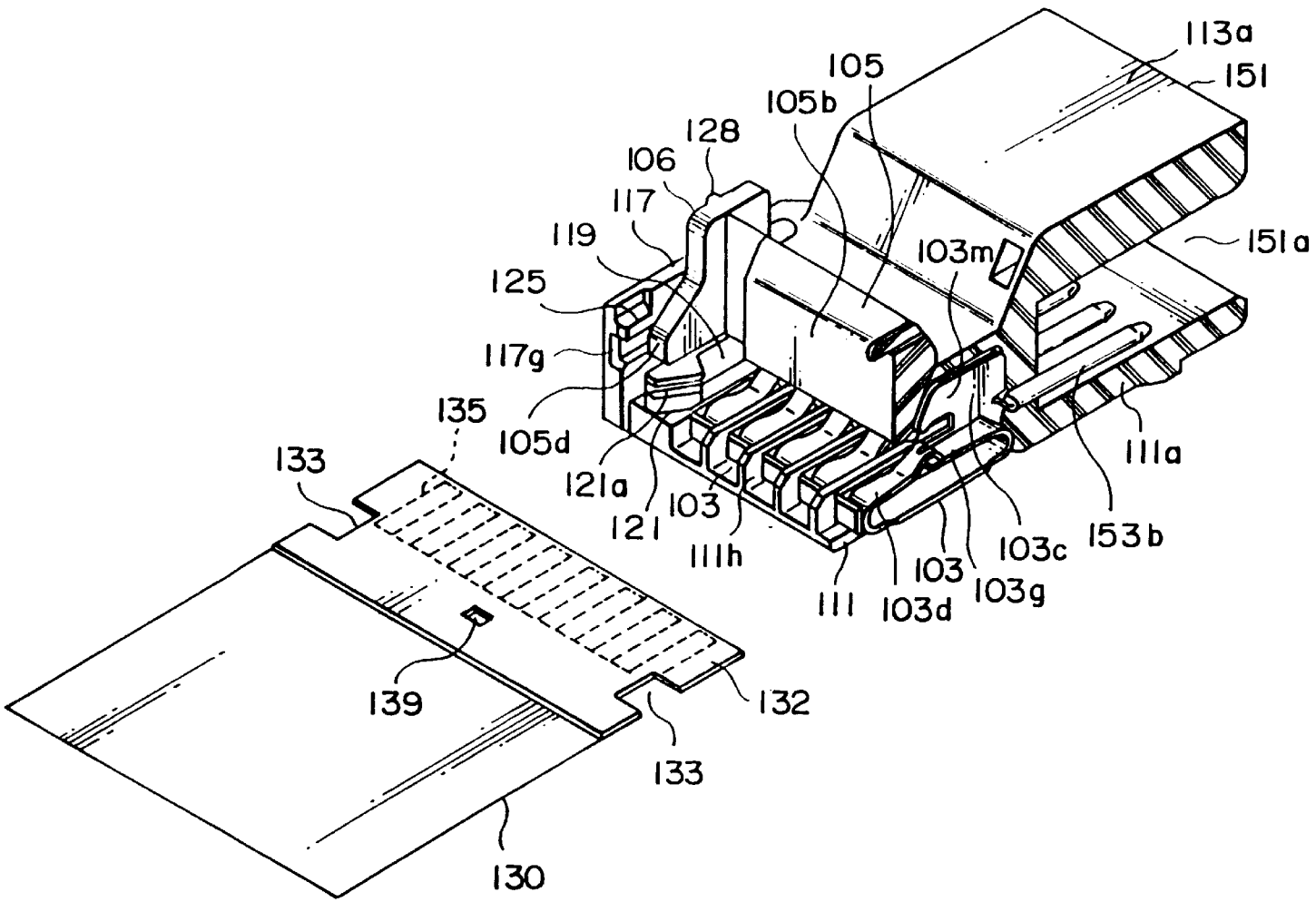
FIG. 20 is a partially-sectional perspective view of the electrical connector illustrated in FIG. 19 before a connection member is connected.

Referring to FIGS. 19 and 20, the electrical connector of the third embodiment has the fitting portion 151 extending rearward from the insulator 101 comprising the first and the second plate portions 111 and 113 and the side plate portions 117. The fitting portion 151 comprises a first fitting plate portion 111*a*, a second fitting plate portion 113*a*, and a fitting base portion 115*a* and is opened at its rear side. The fitting portion 151 has a cavity 151*a* defined between a rear opening and the fitting base portion 115*a*. In the cavity 151*a*, a plurality of connecting portions 153*b* of the contacts 103 extend from the fitting base portion 115*a* towards the rear opening.

Thus, the contact 103 is different from that of the first embodiment in that the connecting portion 153*b* of a pin shape straightly extends rearwards from the holding portion 103*c*.

As illustrated in FIG. 19, the mating connector comprises a mating insulator 161, a receiving portion 161*a* formed in the mating insulator 161, and a plurality of conductive mating contacts 162 arranged in the receiving portion 161*a*.

The mating insulator 161 is provided with an engagement operating section 161*b* formed on its upper surface. The engagement operating section 161*b* has elasticity. One end of the engagement operating section 161*b* is connected to the upper surface of the mating insulator 161.

Each of the mating contacts 162 has a socket portion 162*a* for receiving the connecting portion 153*b* to be connected thereto, a mating holding portion 162*b* supported by the mating insulator 161, and a cable holding portion 162*c* holding and connecting a cable 164.

The engagement operating portion 161*b* has an operating portion 161*c* formed at its one end to be movable up and down when manipulated by an operator, and a projecting portion 161*d* to be engaged with the fitting portion 151 when the mating connector is completely coupled to the fitting portion 151.

Specifically, the projecting portion 161*d* is engaged with a receiving projection 113*d* formed inside of the top end of the second fitting plate portion 113*a*. As the engagement between the fitting portion 151 and the mating connector, various fitting structures are known. Therefore, no further description will be made herein.

Figure 21:
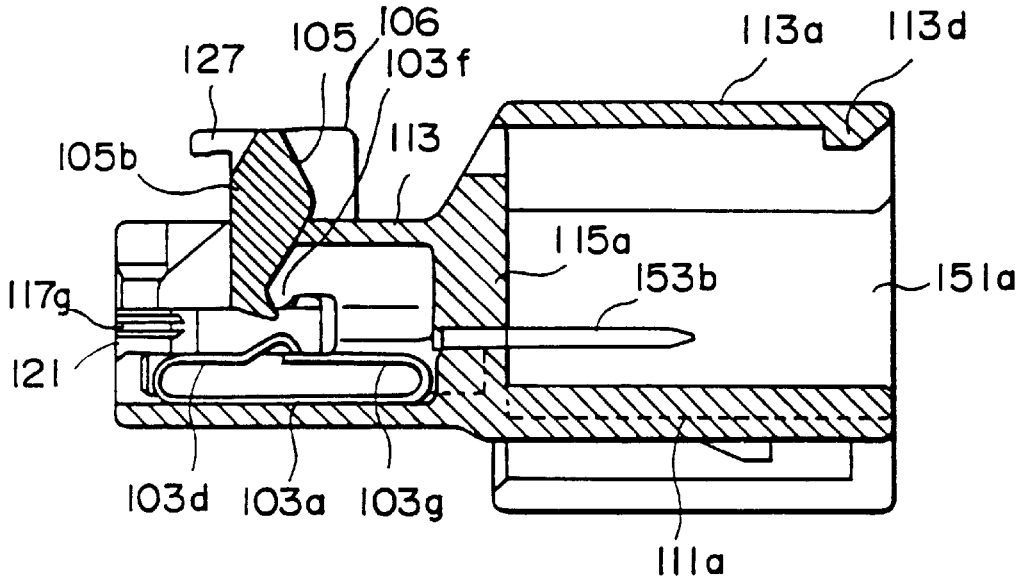
FIG. 21 is a sectional view of the electrical connector illustrated in FIG. 19.
Figure 22:
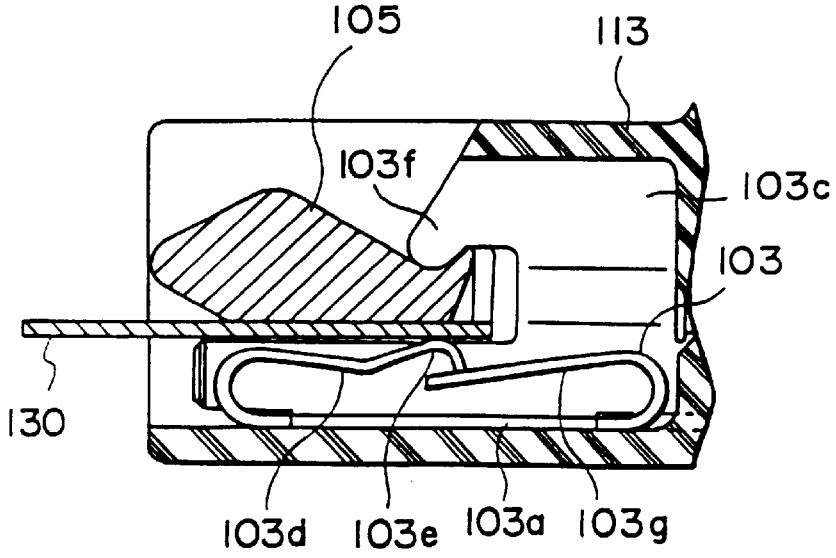
FIG. 22 is a sectional view of the electrical connector in FIG. 19 after the connection member is connected.

As illustrated in FIGS. 21 and 22, the connection member 130 is connected to the contacts 103 by rotating the pressing member 105. The connecting operation is similar to that described in conjunction with the first embodiment and will not be described any longer.

Figure 23:
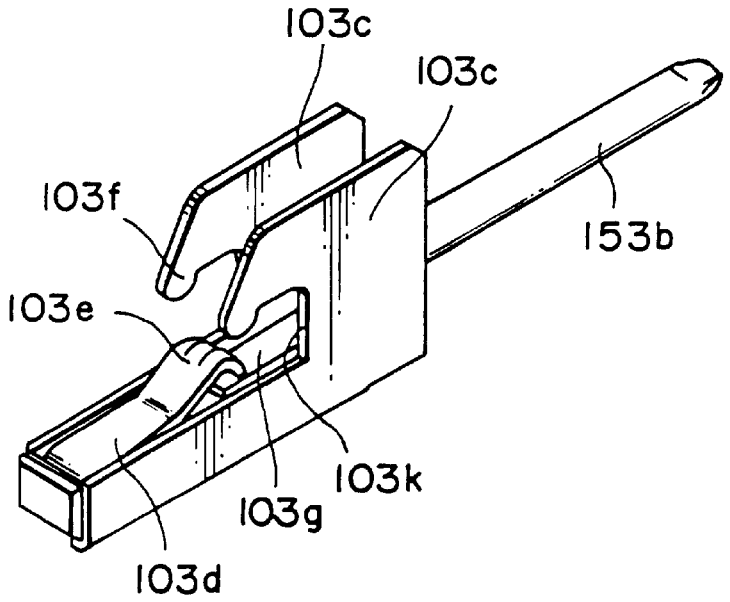
FIG. 23 is a perspective view of a contact illustrated in FIG. 19.
Figure 24:
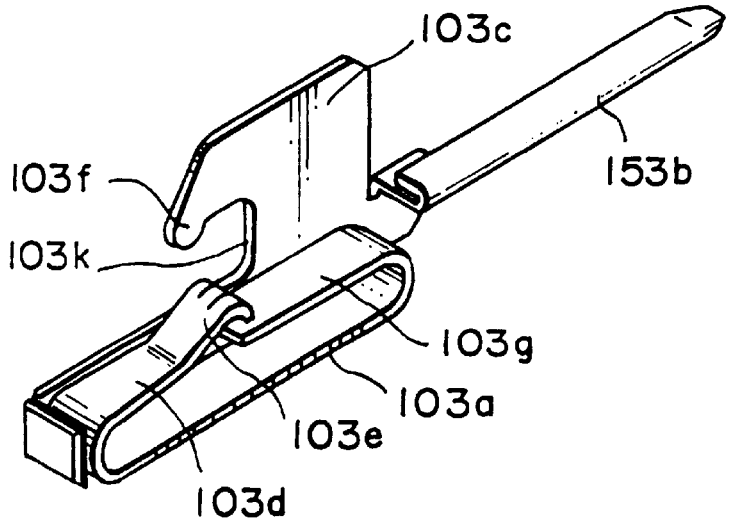
FIG. 24 is a perspective view similar to FIG. 23 with a part cut away.

Referring to FIGS. 23 and 24, the contact 103 in the third embodiment is similar to that of the first embodiment except that the connecting portion 153*b* straightly extends rearward.

Figure 25:
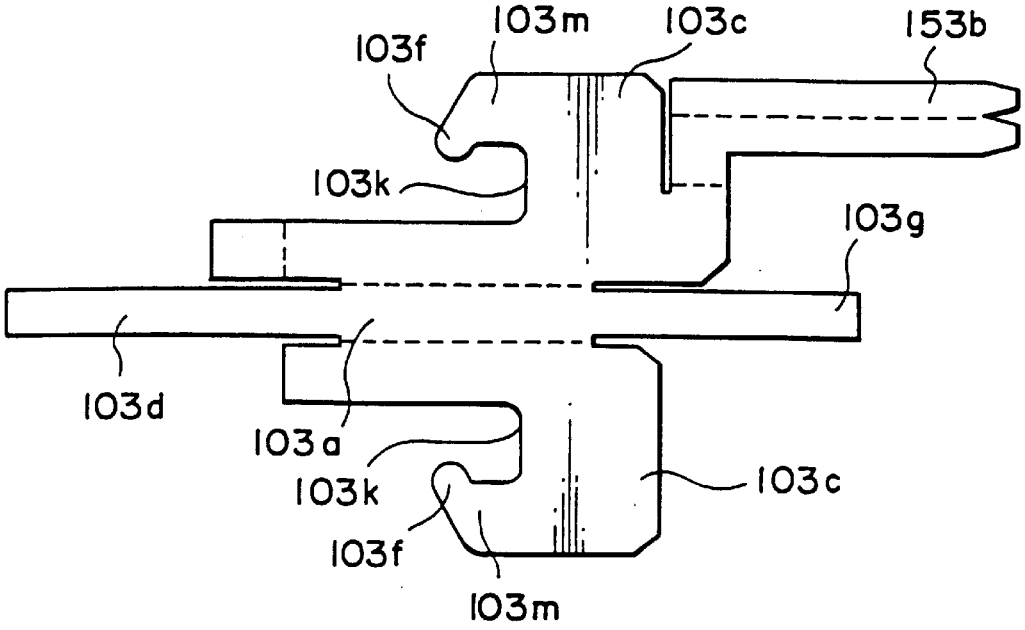
FIG. 25 is a development of the contact illustrated in FIG. 19.

Referring to FIG. 25, the contact 103 is formed by punching a conductive plate by the use of a press into a desired pattern illustrated in the figure and by bending the plate. The pattern illustrated in the figure is common to the contact 103 in the first embodiment except the connecting portion 153*b*.

As will readily be understood, the contact 103 in the first and the second embodiments can easily be made by slightly modifying the pattern illustrated in FIG. 25.

Figure 26:
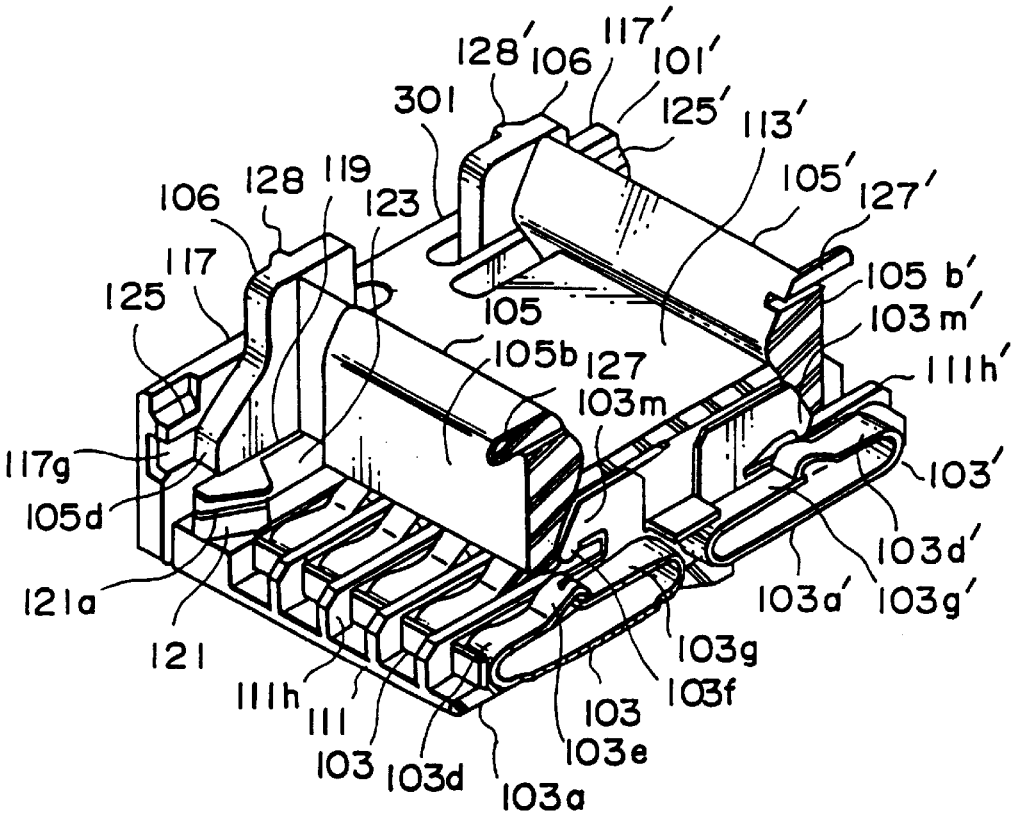
FIG. 26 is a partially-sectional perspective view of an electrical connector according to a fourth embodiment of this invention.
Figure 27:
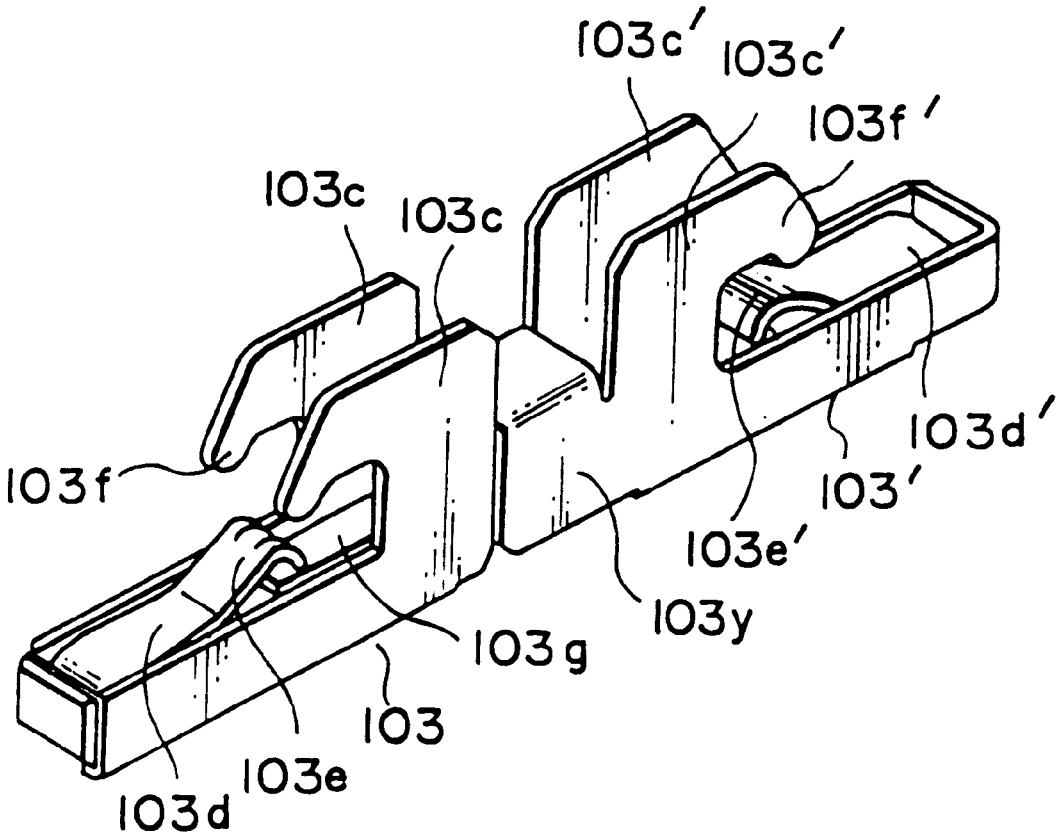
FIG. 27 is a perspective view of a contact illustrated in FIG. 26.

Referring to FIGS. 26 and 27, an electrical connector according to a fourth embodiment of this invention comprises a pair of the connector units each of which is described in conjunction with the first embodiment. These connector units are connected to each other at their rear ends. Thus, the connector units are coupled symmetrically in the inserting direction.

In the electrical connector, a pair of the connection members 130 illustrated in FIG. 15 can be used. The connection members 130 are inserted into the electrical connector from the front and the rear sides, i.e., into first and second connector units, respectively. The connection members 130 are connected to each other through the electrical connector.

As illustrated in FIGS. 26 and 27, the electrical connector comprises the first connector unit including the insulator 101, the contacts 103, and the pressing member 105 similar to the first embodiment, and the second connector unit including an additional insulator 101', a plurality of additional contacts 103', and an additional pressing member 105'.

The insulator 101 is integrally coupled at its rear end with the additional insulator 101 comprising a first additional plate portion 111' and a second additional plate portion 113'. The first plate portion 111 of the insulator 101 is connected to the first additional plate portion 111' extending rearward. The second plate portion 113 of the insulator 101 is connected to the second additional plate portion 113' extending rearward.

On the first additional plate portion 111' connected to the first plate portion 111, the additional contacts 103' similar to the contacts 103 formed on the first plate portion 111 and the additional pressing member 105' similar to the pressing member 105 are attached in the manner similar to the first embodiment.

Thus, the connector units each of which is similar to that described in the first embodiment are symmetrically coupled in the inserting direction.

In the above-mentioned electrical connector, the connection member 130 is inserted from the front side to a first predetermined connecting position over the contacts 103 and the pressing member 105 is rotated as illustrated in FIG. 18. In addition, an additional connection member 130' similar to the connection member 130 is inserted from the rear side to a second predetermined connecting position over the additional contacts 103' and the additional pressing member 105' is rotated. The connection member 130 and the additional connection member 130' are pressed by the pressing member 105 and the additional pressing member 105' to be connected to the contacts 103 and the additional contacts 103', respectively.

Each of the contacts 103 and each corresponding one of the additional contacts 103' are connected to each other through a coupling portion 103*y* extending from lower parts of the holding portion 103*c* of the contact 103 and an additional holding portion 103*c'* of the additional contact 103', respectively. The coupling portion 103*y* is formed by bending the lower parts of the holding portion 103*c* and the additional holding portion 103*c'*. The contact 103 and the additional contact 103' are symmetrical with respect to the coupling portion 103*y*.

Each of the contacts 103 and the additional contacts 103' is similar in structure to the contact 103 of the first embodiment except that the coupling portion 103*h* and the connecting portion 105*b* in the first embodiment are omitted. Therefore, the remaining structure of the electrical connector and the connection of the connecting member 130 will not be described any longer.

The additional insulator 101' and the additional pressing member 105' are similar in structure to the insulator 101 and the pressing member 105 in the first embodiment. Similar parts are described by like reference numerals and will not be described any longer.

As described above, when the connection member is not properly inserted to the predetermined connecting position in the insulator, the detecting arrangement inhibits the rotation of the pressing member. Therefore, according to this invention, a further progress of the connecting operation is inhibited in case where the connection member is incompletely inserted.

During the connecting operation, the connection member is temporarily held by the locking arms. Therefore, it is possible to prevent the connection member from being easily released from the insulator under external force or vibration before the pressing member is completely inserted and locked. Thus, the connecting operation is facilitated.

Upon insertion of the connection member into the insulator, click feeling is obtained by the displacement of the locking arms. Therefore, proper insertion of the connection member to the predetermined connecting position is readily confirmed.

After the pressing member is rotated to the predetermined pressing position, the movement of the locking arms is inhibited by the locking portions. Therefore, the connecting member can be held with increased holding force.

The forward end portion of the connection member is completely clamped by the arm pivot and the contacting spring portion under spring force and reactive force, respectively.

Since the contacting spring portion is located between a pair of the holding portions, the connecting member is stably supported to provide reliable connection.

Thus, the contacts of the above-mentioned shape are free from the influence of the shape of the insulator holding the contacts.

Furthermore, the contact has the arm pivot and the supporting notch so as to keep stable and reliable connection even if the connection member is deformed.

What is claimed is:

1. An electrical connector comprising a single connector unit which includes an insulator (101) having an opening portion (102) for receiving a forward end portion of a flat connection member with a pair of protruding ends formed on both sides of said forward end portion, a plurality of conductive contacts (103) fitted in said opening portion to face a plurality of conductive portions (135) formed on one surface of the forward end portion of said connection member, and a pressing member (105) rotatably supported on said insulator so that, after the forward end portion of said connection member is inserted into said opening portion in an inserting direction to reach a predetermined connecting position, said pressing member is rotated to a predetermined pressing position to press the forward end portion of said connection member against the contacts so that said conductive portions and said contacts are connected to each other, wherein said pressing member and said insulator are provided with locking means (125, 128) for locking said pressing member to said insulator after said pressing member is rotated to said predetermined pressing position only when the forward end portion of said connection member is properly located at said predetermined connecting inhibiting the rotation of said pressing member to detect that the forward end portion of said connection member is not properly located at said predetermined connecting position.

2. The electrical connector as claimed in claim 1, wherein said insulator (101) comprises a first plate portion (111) as a base plate, a second plate portion (113) extending in parallel to said first plate portion from a rear side towards a front side over a dimension shorter than that of said first plate portion, a rear plate portion (115) connecting said first and said second plate portions to each other on their rear sides, and a pair of side plate portions (117) connecting lateral side edges of said first and said second plate portions throughout entire lengths from the rear side to the front side.

3. The electrical connector as claimed in claim 2, wherein said detecting means (105*d*, 119) comprises a pair of locking arms (119) each of which extends from said rear plate portion (115) towards the front side along said side plate portion (117) with a predetermined gap kept from the inner surface of said side plate portion, and detecting projections (105*d*) each of which is formed on said pressing plate (106) to enter into the gap between the inner wall surface of said side plate portion and said locking arm when the pressing member (105) is rotated to said predetermined pressing position.

4. The electrical connector as claimed in claim 3, wherein each of said locking arms (119) has an arm projection (121) formed at its one end on the front side to guide the forward end portion of said connection member to said predetermined connecting position over said contacts, and an arm spring portion (123) connected to said arm projection (121) to be deformed when said connection member is inserted between said arm projections to press said arm projections towards the inner surfaces of said side plate portions.

5. The electrical connector as claimed in claim 4, wherein said arm projection has a guide groove (121*a*) for guiding the forward end portion of said connection member (130), said guide groove having a tapered shape narrowing from the front side towards the rear side.

6. An electrical connector as claimed in claim 2, wherein said contacts (103) are arranged in one-to-one correspondence in a plurality of compartments defined by a plurality of vertical partitioning walls (111*h*) formed on said first plate portion.

7. An electrical connector as claimed in claim 6, wherein a part of each of said contacts to be connected to said conductive portion (135) protrudes upward above upper ends of said partitioning walls (111*h*).

8. The electrical connector as claimed in claim 1, wherein said locking means comprises locking portions (125) formed on inner surfaces of said side plate portions, and engaging projections (128) formed on side wall surfaces of pressing plates (106) formed on both sides of said pressing member (105), said engaging projections being faced to the inner wall surfaces of said side plate portions so as to be engaged with said locking portions when said pressing member (105) is rotated to said predetermined pressing position.

9. The electrical connector as claimed in claim 1, wherein:

said contact (103) have a connecting base portion (103*a*) located on said first plate portion (111), a holding portion (103*c*) extending from at least one side edge of said contacting base portion between both longitudinal ends of said contacting base portion and held by said insulator (101), and a contacting spring portion (103*d*) connected to one of the longitudinal ends and extending towards the other end in parallel to said contacting base portion;

said holding portion (103*c*) of said contacts having a support arm portion (103*m*) and a supporting notch (103*k*) opening towards the other end to receive the forward end portion of said connection member (130);

said contacting spring portion (103*d*) having a contact point (103*e*) formed by bending the one end thereof to be brought into contact with said conductive portion (135) of said connection member.

10. The electrical connector as claimed in claim 9, wherein said holding portion (103*c*) is connected to a connecting portion (103*b*) extending outward from said insulator (101) to be connected to a mating connecting element.

11. The electrical connector as claimed in claim 9, wherein said contacting base portion (103*a*) has an auxiliary spring portion (103*g*) extending from the other end towards the one end in parallel to said contacting base portion, said auxiliary spring portion having an one end located beneath said contact point (103*e*).

12. The electrical connector as claimed in claim 9, wherein said support arm portion (103*m*) has an arm pivot (103*f*) formed on its one end to extend towards the one end of said contacting spring portion to be brought into contact with an upper surface of said pressing member (105) when said pressing member (105) is rotated to said predetermined pressing position.

13. The electrical connector as claimed in claim 9, wherein said contact (103) have a pair of holding portions (103*c*) parallel to each other, the forward end portion of said connection member is clamped and fixed by said arm pivots (103*f*) of said holding portions and said contact point (103*e*).

14. The electrical connector as claimed in claim 9, wherein said arm pivot (103*f*) has an arcuate plate shape.

15. The electrical connector as claimed in claim 1, wherein said pressing member (105) has a flat pressing surface (105*b*) for pressing the forward end portion of said connection member to connect said conductive portions (135) to said contacts.

16. The electrical connector as claimed in claim 1, wherein said pressing member (105) has a hook portion (127) to be engaged with a hook receiving hole (139) formed in said connection member (130) when the forward end portion of said connection member (139) is pressed so that said conductive portions are connected to said contacts.

17. The electrical connector as claimed in claim 1, comprising a plurality of said connector units arranged offset from one another in the inserting direction and stacked in a plurality of stages in the vertical direction.

18. The electrical connector as claimed in claim 17, wherein said insulator (101) in each of said connector units comprises a first plate portion (111) as a base plate, a second plate portion (113) extending in parallel to said first plate portion from a rear side towards a front side over a dimension shorter than that of said first plate portion, a rear plate portion (115) connecting said first and said second plate portions to each other on their rear sides, and a pair of side plate portions (117) connecting lateral side edges of said first and said second plate portions, said second plate portion (113) of one of said connector units being connected at its rear side to said first plate portion (111) of the other connector unit.

19. The electrical connector as claimed in claim 1, wherein said insulator (101) has a fitting portion (151) for fitting and connecting a mating connection element, said fitting portion having a plurality of connecting portions (153*b*) to be connected to a plurality of mating contacts of said mating connection element.

20. The electrical connector as claimed in claim 19, wherein said connecting portion (153*b*) has a pin shape.

21. The electrical connector as claimed in claim 1, said connector comprising a pair of said connector units with their two insulators (101) integrally connected to each other at the rear sides, said opening portion (102) and said pressing member (105) of one of said two insulators being formed at positions symmetrical with those of the other of said two insulator, said insulators being provided with said contacts symmetrically arranged, each of said contacts of the one insulator and each corresponding one of the other insulator being coupled back to back at holding portions (103*c*) through a coupling portion (103*y*) extending from said holding portions.

* * * * *

UNITED STATES PATENT AND TRADEMARK OFFICE

CERTIFICATE OF CORRECTION

PATENT NO. : 6,089,905

DATED : July 18, 2000

INVENTOR(S) : Minoru Shimmyo, Tomoyuki Totani, Akira Ohno, Yu Tatebe

It is certified that error appears in the above-indentified patent and that said Letters Patent is hereby corrected as shown below:

Column 3, Line 59, delete "FIG. 10 is a perspective view of the electrical"

Column 4, Line 65, delete "3b" and insert –3a--

Column 4, Line 65, Bold "1" and Italicize --a--

Column 5, Line 1, Bold "1" and Italicize "a"

Column 5, Line 57, delete "13d", insert –3d--

Column 10, Line 2, delete "105" and insert –105d--

Column 10, Line 5, delete "126" and insert --127--

Column 10, Line 6, delete "5", and insert --105--

Column 10, Line 9, delete "126" and insert --127--

Column 11, Line 45, delete "3", and insert –103--

Column 13, Line 61, delete "105b" and insert –103b--

UNITED STATES PATENT AND TRADEMARK OFFICE

CERTIFICATE OF CORRECTION

PATENT NO. : 6,089,905

DATED : July 18, 2000

INVENTOR(S) : Minoru Shimmyo, Tomoyuki Totani, Akira Ohno, Yu Tatebe

It is certified that error appears in the above-indentified patent and that said Letters Patent is hereby corrected as shown below:

Column 16, line 35, delete "139" and insert --130--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*